US008666295B2

(12) United States Patent
Takahashi

(10) Patent No.: US 8,666,295 B2
(45) Date of Patent: Mar. 4, 2014

(54) IMAGE FORMING APPARATUS

(75) Inventor: Hiroaki Takahashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 90 days.

(21) Appl. No.: 13/475,107

(22) Filed: May 18, 2012

(65) Prior Publication Data

US 2012/0315067 A1 Dec. 13, 2012

(30) Foreign Application Priority Data

Jun. 7, 2011 (JP) ..... 2011-126943
Apr. 27, 2012 (JP) ..... 2012-102106

(51) Int. Cl.
*G03G 15/01* (2006.01)

(52) U.S. Cl.
USPC ..... 399/302

(58) Field of Classification Search
USPC ..... 399/302, 208, 312, 313
See application file for complete search history.

(56) References Cited

U.S. PATENT DOCUMENTS

2011/0200837 A1 * 8/2011 Yoshizawa et al.

FOREIGN PATENT DOCUMENTS

| | | | |
|---|---|---|---|
| JP | 11-282277 | | 10/1999 |
| JP | 2001-142313 | | 5/2001 |
| JP | 2004-77576 | | 3/2004 |
| JP | 2005-74914 | | 3/2005 |
| JP | 2007178469 | A * | 7/2007 |
| JP | 2008-225182 | | 9/2008 |
| JP | 2010002628 | A * | 1/2010 |

* cited by examiner

*Primary Examiner* — Susan Lee
(74) *Attorney, Agent, or Firm* — Cooper & Dunham LLP

(57) ABSTRACT

An intermediate transfer belt having a circumferential length not less than 2,000 mm and is driven at a linear speed not less than 350 mm/sec and an inner circumferential surface having a surface roughness Ra of from 0.2 to 0.4 μm (JIS B0601: '01), and including a substrate layer and a high-resistivity layer having a resistivity higher than that of the substrate layer, wherein the high-resistivity layer has a surface resistivity higher than that of the substrate layer by 0.3 to 2.5 log Ω/□ in common logarithm value when applied with a voltage of 500 V.

9 Claims, 2 Drawing Sheets

IMAGE FORMING APPARATUS

CROSS-REFERENCE TO RELATED APPLICATIONS

This patent application is based on and claims priority pursuant to 35 U.S.C. §119 to Japanese Patent Applications Nos. 2011-126943 and 2012-102106, filed on Jun. 7, 2011 and Apr. 27, 2012, respectively in the Japanese Patent Office, the entire disclosure of which is hereby incorporated herein by reference.

FIELD OF THE INVENTION

The present invention relates to an image forming apparatus using a seamless belt such as copiers and printers, and particularly to an image forming apparatus using an intermediate transfer belt preferably used for forming full-color images.

BACKGROUND OF THE INVENTION

Conventionally, seamless belts are used in various applications in electrophotographic image forming apparatus. Particularly, in recent full-color electrophotographic image forming apparatus, an intermediate transfer belt is used, on which four developed yellow, magenta, cyan and black images are overlapped and the overlapped images are transferred onto a transfer medium such as a paper at a time.

Four (color) image developers have been used for one photoreceptor when using the intermediate transfer belt, which had a disadvantage of low printing speed. Therefore, in high-speed printing, a train-of-four tandem method continuously transferring each color to a paper with four (color) photoreceptors. However, this is difficult to adjust positional preciseness of overlapping each color due to paper quality, etc., resulting in production of color-shifted images. Then, the train-of-four tandem method has mostly used the intermediate transfer belt recently.

The intermediate transfer belt is also required to satisfy transfer at higher speed and positional preciseness. Particularly, it is required to prevent deformation such as elongation after continuously used for the positional preciseness. Further, the intermediate transfer belt is located over a wide range of the apparatus and required to have flameproofness because of being applied with a high voltage for transfer. In compliance with these requirements, a polyimide resin having high elasticity and high heat resistance is mostly used as a material of the intermediate transfer belt.

Recently, even a full-color electrophotographic image forming apparatus is being required to have high speed printing capability, and high durability and stability. In compliance with the high speed printing capability and high durability, a large apparatus is driven at high speed, and even the intermediate transfer belt needs to have longer circumferential length and to be driven at high speed.

Such an enlarged intermediate transfer belt and a system using the belt have other problems the conventional belt/system do not have. One of them is travelling stability of the intermediate transfer belt. Specifically, the intermediate transfer belt slips on a drive roller driving the belt because of rotating at high speed, resulting in production of color-shifted images, or the belt is likely to be damaged when shifted.

Another problem is uneven properties of the belt. One belt occasionally has uneven properties according to its positions, resulting in production of images having uneven quality. A mould a resin solution is coated on is heated and dried/crosslinked to prepare a typical polyimide belt. A very large mold used to prepare a large belt having a circumferential length not less than 2,000 mm is difficult to uniformly control the temperature of the whole mold, and thought to have uneven properties.

A further problem is a white spot a toner is not transferred onto. When a transfer bias is controlled by constant current control, white spots tend to occur in an environment of low temperature and low humidity, on a backside in both side printing, on a paper having high resistivity, and when the transfer bias is high. The apparatus having high linear speed needs to apply a high voltage to the belt travelling at high speed to pass a transfer nip in a shorter time, which is thought to cause white spots.

Another problem of the intermediate transfer belt is shape and size stability against environmental variation.

The belt tends to curl due to the environmental variation.

The intermediate transfer belt is formed of an endless belt extended by plural rollers with tension. The belt is applied with a predetermined tension by tension rollers and the tension is applied thereto even when remaining still. Therefore, when the belt is left for hours without running, a part thereof supported by the roller is curled. Then, the belt deteriorates in runnability, a toner image transferred onto the curled part is poorly transferred onto a paper, resulting in abnormal images such as stripe images. Further, the belt needs to have size stability when absorbing moisture, particularly a large belt largely varying in size because of having a long circumferential length.

Japanese published unexamined application No. 2008-225182 discloses a polyimide belt having an inner surface roughness (Ra) of from 0.15 to 0.6 μm and a maximum surface roughness of from e to 15 μm to prevent slidability thereof and abrasion powder. However, the belt has a conventional size and possibly has insufficient runnability and other various troubles when enlarged.

Japanese published unexamined application No. 2005-74914 discloses a method of preparing a tubular material without uneven temperature. An apparatus including a cylindrical mold placing a heat pipe including a hollow where a heat medium is circulated on its circumferential wall, and an electromagnetic induction coil electromagnetically heating in the mold is used. Even such an apparatus has uneven temperature.

Japanese published unexamined application No. 2001-142313 discloses a polyamide resin which is a copolymer repeating an A component having an imide bond between a wholly aromatic skeleton which is a tetracarboxyl residue and a p-phenylene skeleton which is a diamine residue, and a B component having an imide bond between the wholly aromatic skeleton which is a tetracarboxyl residue and a diphenyl ether skeleton; and/or a blend mixing a polymer including the A component as a repeat unit and a polymer including the B component as a repeat unit, and which satisfies the following relationship:

$$R \leq 65 - W$$

wherein R represents % by mol of the A component and W represents parts by weight thereof per 100 parts by weight of the polyimide resin which is an electroconductive filler. Such a polyimide resin improves a balance between the flexibility and the rigidity of a belt. However, the backside roughness is not considered and stable runnability is difficult to obtain, and the white spot is not considered at all, either.

Japanese published unexamined application No. 11-282277 discloses an image forming apparatus having a multilayered intermediate transfer belt including a high-resistivity surface layer forming an outer circumferential surface of the belt bearing a toner image and a middle-resistivity base layer forming an inner circumferential surface thereof a transfer bias is applied to. The high-resistivity surface layer has high electrical pressure resistance to prevent the white spot. However, when used in a high-speed machine as a large belt, the belt possibly has problems of runnability and uneven properties because they are not considered.

Because of these reasons, a need exits for a large and high-speed intermediate transfer belt stably running for long periods, having less uneven properties and stable shape and size against the environment, and producing quality images without white spots.

SUMMARY OF THE INVENTION

Accordingly, an object of the present invention to provide a large and high-speed intermediate transfer belt stably running for long periods, having less uneven properties and stable shape and size against the environment, and producing quality images without white spots.

This object and other objects of the present invention, either individually or collectively, have been satisfied by the discovery of an image forming apparatus, comprising:

an image bearer configured to bear an image;

an irradiator configured to irradiate the image bearer to form an electrostatic latent image thereon;

an image developer configured to develop the electrostatic latent image with a developer comprising a toner to form a toner image;

a transferer comprising an intermediate transfer belt configured to transfer a toner image onto a recording medium; and a fixer configured to fix the toner image on the recording medium, wherein the intermediate transfer belt has a circumferential length not less than 2,000 mm and is driven at a linear speed not less than 350 mm/sec, has an inner circumferential surface having a surface roughness Ra of from 0.2 to 0.4 μm, and comprises a substrate layer and a high-resistivity layer having a resistivity higher than that of the substrate layer, wherein the high-resistivity layer has a surface resistivity higher than that of the substrate layer by 0.3 to 2.5 log Ω/□ in common logarithm value when applied with a voltage of 500 V, and wherein the substrate layer is formed of a polyimide resin comprising a polyimide resin component (S) having an imide bond between 3,3',4,4'-biphenyltetracarboxylic dianhydride and p-phenylenediamine and a polyimide resin component (A) having an imide bond between 3,3',4,4'-biphenyltetracarboxylic dianhydride and 4,4'-diaminodiphenylether in a weight ratio (S/A) of from 0/100 to 40/60.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
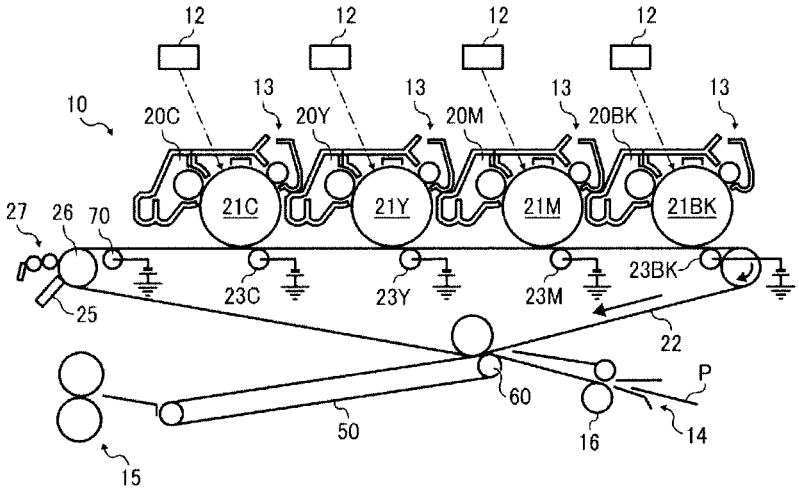
FIG. 1 is a schematic view illustrating an embodiment of the image forming apparatus of the present invention.

The present invention provides a large and high-speed intermediate transfer belt stably running for long periods, having less uneven properties and stable shape and size against the environment, and producing quality images without white spots.

More particularly, the present invention relates to an image forming apparatus, comprising:

an image bearer configured to bear an image;

an irradiator configured to irradiate the image bearer to form an electrostatic latent image thereon;

an image developer configured to develop the electrostatic latent image with a developer comprising a toner to form a toner image;

a transferer comprising an intermediate transfer belt configured to transfer a toner image onto a recording medium; and a fixer configured to fix the toner image on the recording medium, wherein the intermediate transfer belt has a circumferential length not less than 2,000 mm and is driven at a linear speed not less than 350 mm/sec, has an inner circumferential surface having a surface roughness Ra of from 0.2 to 0.4 μm, and comprises a substrate layer and a high-resistivity layer having a resistivity higher than that of the substrate layer, wherein the high-resistivity layer has a surface resistivity higher than that of the substrate layer by 0.3 to 2.5 log Ω/□ in common logarithm value when applied with a voltage of 500 V, and wherein the substrate layer is formed of a polyimide resin comprising a polyimide resin component (S) having an imide bond between 3,3',4,4'-biphenyltetracarboxylic dianhydride and p-phenylenediamine and a polyimide resin component (A) having an imide bond between 3,3',4,4'-biphenyltetracarboxylic dianhydride and 4,4'-diaminodiphenylether in a weight ratio (S/A) of from 0/100 to 40/60.

The image forming apparatus of the present invention uses an intermediate transfer belt and drives a large image forming module at high speed. The intermediate transfer belt has a circumferential length not less than 2,000 mm and drives at linear speed not less than 350 mm/sec. In such a large image forming apparatus, a belt or a photoreceptor has a long circumferential length and has a rotational number less than that of a small image forming apparatus to produce the same number of images. Therefore, the belt or the photoreceptor has higher durability because of receiving less damage such as abrasion and has high durability.

The intermediate transfer belt of the present invention has an inner circumferential surface contacting a drive roller and having a surface roughness Ra of from 0.2 to 0.4 μm when measured by a method specified in JIS B0601: '01. Then, even when driven at high speed, the intermediate transfer belt is difficult to slip or shift. When larger than 0.4 μm, a contact area between the belt and the drive roller decreases, and the belt is likely to slip. When less than 0.2 μm, a frictional force between the belt and the drive roller is large and an end of the belt receives a large stress when scraping against other members when shifted. Therefore, the end of the belt is likely to receive a large damage and runnability thereof deteriorates.

The surface roughness Ra is measured according to JIS B0601: '01, using SURFCOM 1400D from TOKYO SEIMITSU CO., LTD. at a measurement speed of 0.6 mm/sec, a cutoff value of 0.8 mm and a measurement length of 2.5 mm. Each 3 parts in a circumferential direction and a width direction (center and both ends) of the belt (totally 9 points) are measured and averaged.

Figure 2A:
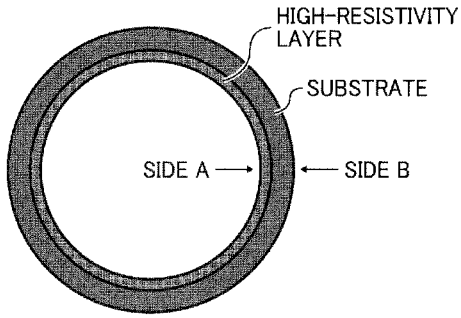
FIG. 2A is a schematic cross-sectional view of the intermediate transfer belt having a high-resistivity layer inside.
Figure 2B:
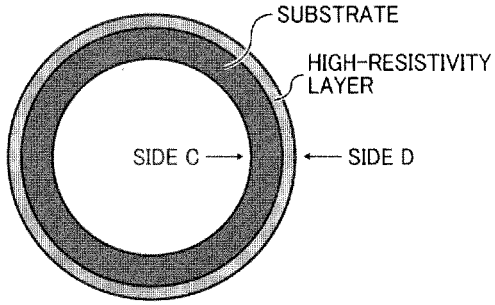
FIG. 2B is a schematic cross-sectional view of the intermediate transfer belt having a high-resistivity layer on the outer circumference.

The intermediate transfer belt of the present invention is a layered belt formed of a substrate layer and a high-resistivity layer having a resistivity higher than that of the substrate layer. The order of the layers is not particularly limited, the high-resistivity layer may be layered on an inner or an outer circumference of the belt as FIGS. 2A and 2B show, respectively. The high-resistivity layer increases an electrical pressure resistance to prevent production of the white spots.

A difference (ρs high−ρs sub) between a surface resistivity (ρs high) (common logarithm value log Ω/□) of the high-resistivity layer (side A and side D in FIGS. 2A and 2B, respectively) and a surface resistivity (ρs sub) (common logarithm value log Ω/□) of the substrate layer (side B and side C in FIGS. 2A and 2B, respectively) is from 0.3 to 2.5 log Ω/□ when applied with a voltage of 500 V. When less than 0.3 log Ω/□, the belt does not have sufficient electrical pressure resistance to prevent production of the white spots. When greater than 2.5 log Ω/□, a potential on the surface of the belt is difficult to decay, resulting in production of abnormal images such as residual images.

The surface resistivity of the substrate layer or the high-resistivity layer can be controlled by a content of a resistivity adjuster and a thickness of the layer. When the content of the resistivity adjuster decreases and the thickness of the layer increases, the surface resistivity increases. The surface resistivity of the substrate layer or the high-resistivity layer is controlled by the content of the resistivity adjuster and the thickness of the layer to control the difference between the surface resistivity of the substrate layer and that of the high-resistivity layer in the above-mentioned range.

A high-strength resin less deforming and difficult to crack the belt even when driven at high speed the is used for the substrate layer. Therefore, a polyimide resin including a polyimide resin component (S) having an imide bond between 3,3', 4,4'-biphenyltetracarboxylic dianhydride and p-phenylenediamine and a polyimide resin component (A) having an imide bond between 3,3',4,4'-biphenyltetracarboxylic dianhydride and 4,4'-diaminodiphenylether in a weight ratio (S/A) of from 0/100 to 40/60 is used as a resin having high elasticity, high folding endurance and high tearing strength. The polyimide resin component (A) can be used alone, but the polyimide resin component (S) is preferably mixed therewith in consideration of higher elasticity. However, when a large belt having a circumferential length not less than 2,000 mm including a larger amount of the polyimide resin component (S) is prepared, the belt is likely to have uneven electrical properties, resulting in possible production of images having uneven quality. A large mold preparing the belt having a circumferential length not less than 2,000 mm is difficult to have a uniform temperature, and therefore the belt is thought to have uneven properties. A reason is not clarified, but when S has a ratio not greater than 40%, the belt properties are stable, and when greater than 40%, the properties noticeably vary.

Further, S preferably has a ratio not less than 10%. The belt tends to have a small hygroscopic linear expansivity and a small size variation against the environment. The hygroscopic linear expansivity is preferably not greater than 22 ppm/% RH.

Figure 3:
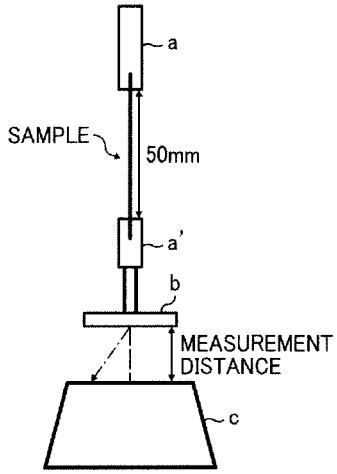
FIG. 3 is a schematic view illustrating a hygroscopic linear expansivity measurer.

The hygroscopic linear expansivity is measured by the measurer in FIG. 3. The measurer 1 includes a pair of arms a and a' holding both ends of a sample sheet, an aluminum weight b located below the lower arm a', adjusting a linear pressure to the sample, and a reflection laser micro gauge c located below the weight b.

A polyimide sheet as a sample having a predetermined size, i.e., a width of 10 mm and a length of 70 mm cut from the center of a seamless belt is placed such that a distance between inner sides of the arms a and a' is 50 mm. The weight of the aluminum weight b is adjusted such that a linear pressure to the sample is 150 g/cm.

After that, the measurer is placed in a constant temperature and humidity tank, and a difference (ΔL) between the expansions of the sample at 35° C. and 85% RH and 35° C. and 35% RH is measured to determine the hygroscopic linear expansivity, using the following formula:

$$\text{Hygroscopic linear expansivity (ppm/\% } RH) = (\Delta L/50\text{ mm})/50\%.$$

The expansion is a distance from the bottom of the weight b to the reflection laser micro gauge c.

Further, the high-resistivity layer is preferably formed of a polyimide resin including the S component and the A component in a weight ratio (S/A) of from 0/100 to 40/60 on an inner circumferential surface of the intermediate transfer belt. As mentioned above, the intermediate transfer belt has suitable roughness on its surface contacting the belt drive roller to stabilize belt drive, and when the surface is abraded as time passes, the roughness varies and the belt possibly deteriorates in running. The intermediate transfer belt can maintain suitable roughness on its surface contacting the belt drive roller when including a resin having a high ratio of the S component and high abrasion resistance, and has higher runnablity. The resin having a high ratio of the S component deteriorates in folding endurance, but has no problem when used in the high-resistivity layer because it can be thin.

Further, it is preferable that the high-resistivity layer is formed on the inner circumferential surface of the intermediate transfer belt, the high-resistivity layer and the substrate layer include a polyimide resin having the same S/A ratio, and the same carbon black is dispersed in the polyimide resin. The two layers do not easily peel from each other or have cracks. The intermediate transfer belt including the high-resistivity layer on the inner circumferential surface thereof, including less carbon black does not curl easily.

When a belt is prepared with the same resin and the same carbon black, the high-resistivity layer includes less carbon black. Curl properties are different from each other when a side of the high-resistivity layer including less carbon black is wound around a roller and when a side of the substrate layer including more carbon black is wound around a roller. The high-resistivity layer including less carbon black has better curl properties. When the intermediate transfer belt is extended with tension by rollers, the inner circumferential surface thereof is wound around the roller. Therefore, the high-resistivity layer having better curl properties is formed on the inner circumferential surface of the belt to improve curl properties.

When the high-resistivity layer and the substrate layer include a resin different from each other, they have different properties such as mechanical properties and possibly peel from each other or have cracks when the high-resistivity layer is thicker. When the high-resistivity layer and the substrate layer include a resin different from each other, the following relationship is preferably satisfied:

$$t_1/t_2 \times 100 \leq 20$$

wherein $t_1$ represents a thickness of the high-resistivity layer and $t_2$ represents a thickness of the whole belt.

This is preferably satisfied as well in consideration of the folding endurance.

The belt preferably has a total thickness not greater than 100 μm. When thicker than 100 μm, it is likely a toner is not partially transferred on line images or isolated dots formed in a travel direction of a photoreceptor, i.e., moth-eaten images are produced.

The inter mediate transfer belt of the present invention include an electrical resistance adjuster adjusting an electrical resistance in the polyimide resin.

The electrical resistance adjuster includes metal oxides, carbon black, ion conductivizers, conductive polymers, etc.

Specific examples of the metal oxides include zinc oxide, tin oxide, zirconium oxide, aluminum oxide, silicon oxide, etc. Surface-treated metal oxides having better dispersibility can also be used.

Specific examples of the carbons black include ketjen black, furnace black, acetylene black, thermal black, gas black, etc.

Specific examples of the ion conductivizers include tetraalkylammonium salts, trialkylbenzylammonium salts, alkylsulfonic acid salts, alkylbenzenesulfonic acid salts, alkylsulfates, glycerin fatty acid esters, sorbitan fatty acid esters, polyoxyethylenealkylamine, polyoxyethylene fatty alcohol esters, alkylbetaines, lithium perchlorate, etc. These can be sued alone or in combination.

The electrical resistance adjusters of the present invention are not limited to the above-mentioned compounds.

A coating liquid including at least a resin for preparing the intermediate transfer belt may further include additives such as a dispersion aid, a reinforcing agent, a lubricant and an antioxidant when necessary.

The substrate layer of the intermediate transfer belt of the present invention preferably includes the electrical resistance adjusters in an amount of from 10 to 25%, and more preferably from 15 to 20% by weight based on total weight of the coating liquid when the electrical resistance adjuster is carbon black. Preferably from 1 to 50% by weight, and more preferably from 10 to 30% by weight when the electrical resistance adjuster is a metal oxide.

The high-resistivity preferably has a surface resistivity of from $1\times10^{10}$ to $1\times10^{14}$ Ω·cm. The substrate layer preferably has a surface resistivity of from $1\times10^{9}$ to $1\times10^{12}$ Ω·cm.

The polyimide resin for use in the present invention is explained.

An aromatic polyimide resin is obtained through a polyamic acid (polyimide precursor) from a reaction between an aromatic polycarboxylic acid anhydride (or its derivative) and an aromatic diamine.

In the present invention, 3,3',4,4'-biphenyltetracarboxylic dianhydride as the aromatic polycarboxylic acid anhydride and p-phenylenediamine and/or 4,4-diaminodiphenyl ether as the aromatic diamine are used.

Hereinafter, 3,3',4,4'-biphenyltetracarboxylic dianhydride is called the aromatic polycarboxylic acid anhydride, and p-phenylenediamine and 4,4-diaminodiphenyl ether are called the aromatic diamine unless otherwise specified. Then, methods of preparing the S and A components are explained.

The aromatic polyimide is insoluble in solvents because of its rigid main chain structure, and unmeltable. First, a polyimide precursor (polyamic acid) soluble in organic solvents is synthesized from a reaction between the aromatic polycarboxylic acid anhydride and the aromatic diamine. The polyamic acid is shaped by various methods, and heated or chemically dehydrated to be cyclized (imidized) to form polyimide. The aromatic polyimide is formed, e.g., as follows.

(1)

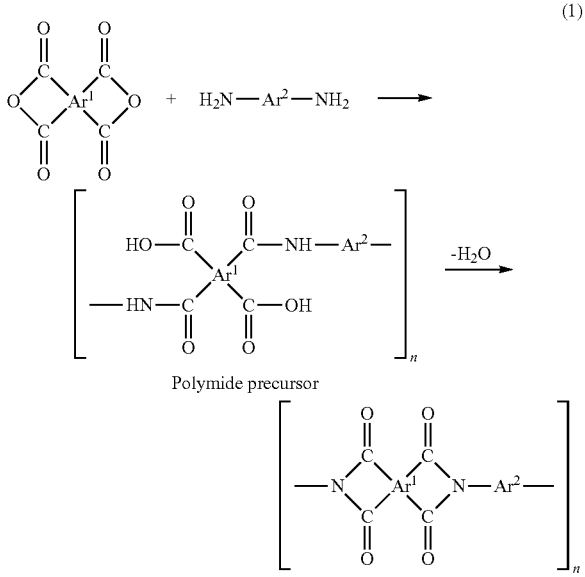

In the formula (1), $Ar^1$ represents

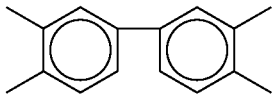

and $Ar^2$ represents

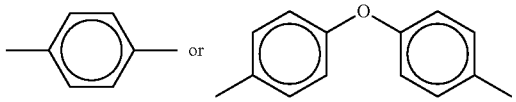

When $Ar^2$ has the left structure, the resultant compound is p-phenylenediamine. When $Ar^2$ has the right structure, the resultant compound is 4,4'-diaminodiphenylether.

Almost same moles of the aromatic polycarboxylic acid anhydride and the aromatic diamine are subjected to a polymerization reaction in an organic polar solvent to prepare a polyimide precursor (polyamic acid). Then, the polyamic acid is dehydrated to be cyclized and imidized. A method of preparing the polyamic acid is specifically explained.

Specific example of the organic polar solvent include sulfoxide solvents dimethylsulfoxide and dimethylsulfoxide; formamide solvents such as N,N-dimethylformamide and N,N-diethylformamide; acetoamide solvents such as N,N-dimethylacetoamide and N,N-dimethylacetoamide; pyrrolidone solvents such as N-methyl-2-pyrrolidone and N-vinyl-2-pyrrolidone; phenol solvents such as phenol, o-, m- or p-cresol, xylenol, phenol halogenated and catechol; ether solvents such as tetrahydrofuran, dioxane and dioxolane; alcohol solvents such as methanol, ethanol and butanol; cellosolves such as butylcellosolve; hexamethylphosphoramide; and y-butyllactone. These can be used alone or in combination.

The solvents are not particularly limited as long as they dissolve the polyamic acid, but N,N-dimethylacetoamide and N-methyl-2-pyrrolidone are preferably used in particular.

When the polyimide precursor is prepared, under an atmosphere of inactive gas such as argon and nitrogen, one or more diamines is dissolved or dispersed to be in the form of slurry in the organic solvent. At least one of the aromatic polycarboxylic acid anhydride (or its derivative) added in this solvent (in the form of a solid, a solution or a slurry). A ring-opening polyaddition reaction occurred with heat and the solution quickly increases in viscosity to prepare a polymeric polyamic acid solution. The reaction temperature is typically from 20 to 100° C., and preferably not higher than 60° C. the reaction time is 30 min to 12 hrs.

Alternatively, the aromatic polycarboxylic acid anhydride or its derivative is dissolved or dispersed in the organic solvent first, and the aromatic diamine (hereinafter referred to as "diamine") may be added to the solution in the form of a solid, a solution or a slurry. Namely, the order of mixing the aromatic polycarboxylic acid anhydride and the diamine is not limited. Further, the aromatic polycarboxylic acid anhydride and the diamine may be added to the organic polar solvent at the same time.

As mentioned above, almost the same moles of the polycarboxylic acid anhydride or its derivative and the aromatic diamine are subjected to a polymerization reaction in the organic polar solvent to prepare a polyimide precursor solution in which a polyamic acid is uniformly dissolved in the organic polar solvent.

The polyimide precursor solution (polyamic acid solution: "a coating liquid including a polyimide resin precursor") synthesized as above can be used in the present invention. Simply, a marketed polyimide varnish in which polyamic acid compositions are dissolved in an organic solvent can also be used.

Specific examples of the marketed polyimide varnish include U-varnish from Ube Industries, Ltd.

An electrical resistance adjuster may be added to the polyamic acid solution in a suitable amount when necessary. When forming the high-resistivity layer, the electrical resistance adjuster is included therein less than that in the substrate layer. Further, additives such as a dispersion aid, a reinforcing agent, a lubricant and an antioxidant are mixed and dispersed when necessary to prepare a coating liquid. After the coating liquid is coated on a substrate, the liquid is heated such that the polyamic acid as the polyimide precursor is transformed (imidized) to polyimide.

The resultant imidized polyimide resin is thought to include the S and A components in a weight ratio same as that of reduced quantities of polyamic acid solid contents imidized to the S and A components in the polyamic acid solution.

The polyamic acid can be imidized by (1) heating or (2) chemical methods.

(1) heating methods heat the polyamic acid at 250 to 450° C. to transform the polyamic acid to polyimide. This is a simple and practical method to prepare polyimide (a polyimide resin).

The (2) chemical methods react the polyamic acid with a cyclodehydration reagent such as a mixture of carboxylic acid anhydride and tertiary amine, and heat the reactant to completely be imidized. Since this is more complicated and costs more than the (1) heating methods, and therefore the (1) heating methods are mostly used. It is preferable that the polyamic acid is heated at a glass transition temperature of the equivalent polyimide and the imidization is completed to exert the original performance of the polyimide.

The imidization is evaluated by conventional methods.

The methods include various methods such as a nuclear magnetic resonance spectroscopic method (NMR method) calculating from an integral ratio between $^1$H belonging to an amide group having 9 to 11 ppm and $^1$H belonging to an aromatic ring having 6 to 9 ppm; a Fourier transform infrared spectroscopic method (FT-IR method); a method of determining quantity of a moisture caused by imide ring closure; and a carboxylic acid neutralization titration method. Among these, the Fourier transform infrared spectroscopic method (FT-IR method) is most typically used.

The Fourier transform infrared spectroscopic method (FT-IR method) defines the imidization by the following formula (a):

$$\text{Imidization}(\%)=A/B\times 100 \quad \text{(a)}$$

wherein A represents a molar number of imide groups when heated and B represents a molar number of imide groups when imidized by 100% theoretically.

The molar number of the imide groups is determined by an absorbance ratio of a characteristic absorption thereof measured by FT-IR method. Typical characteristic absorptions include the following absorbance ratios:

(1) an absorbance ratio between one of imide characteristic absorptions 725 $cm^{-1}$ (a variable angle oscillation zone of imide ring C═O group) and a benzene ring characteristic absorption 1,015 $cm^{-1}$;

(2) an absorbance ratio between one of imide characteristic absorptions 1,380 $cm^{-1}$ (a variable angle oscillation zone of imide ring C═N group) and a benzene ring characteristic absorption 1,500 $cm^{-1}$;

(3) an absorbance ratio between one of imide characteristic absorptions 1,720 $cm^{-1}$ (a variable angle oscillation zone of imide ring C═O group) and a benzene ring characteristic absorption 1,500 $cm^{-1}$; and (4) an absorbance ratio between one of imide characteristic absorptions 1,720 $cm^{-1}$ and an amide group characteristic absorption 1,670 $cm^{-1}$ (an interaction between a variable angle oscillation of amide group N—H and C—N stretching oscillation).

Disappearance of a multiple absorption zone from 3,000 to 3,300 $cm^{-1}$ from the amide group increases reliability for completion of the imidization.

Next, a method of preparing an intermediate transfer belt using a coating liquid including the polyimide resin precursor is explained.

In the present invention, methods of preparing a seamless belt using the coating liquid including the polyimide precursor include a method of coating the liquid on the outer surface of a mold (a cylinder) with a nozzle or a dispenser. The belt has an inner circumferential surface contacting to the outer surface of the mold. The inner circumferential surface contacts the belt drive roller, and the mold surface is roughened by a sand blast to have a surface roughness Ra of from 0.2 to 0.4 μm.

The coated film formed on the outer surface of the mold is dried and/or hardened to form a film having the shape of a seamless belt, and the film is released from the mold to prepare an intermediate transfer belt.

As a method of preparing an intermediate transfer belt, a centrifugal molding coating the coating liquid on the inner surface of a mold (a cylinder) is widely known as well. The inner circumferential surface of the belt does not contact the mold and is smooth and difficult to have the roughness of the present invention.

A method of preparing the belt having a high-resistivity layer on the inner circumferential surface as FIG. 2A shows is explained.

First, a high-resistivity layer is formed. While a cylindrical metallic mold is slowly rotated, a coating liquid is coated on the whole outer surface with a liquid applicator such as a nozzle and a dispenser to form a coated film thereon. Then, the rotational speed is increased to a predetermined speed and the speed is maintained for a desired time. Then, the mold is gradually heated while rotated to vapor a solvent in the coated film at 80 to 150° C. In this process, it is preferable that an atmospheric mist (volatilized solvent) is efficiently circulated to remove. When a self-supporting film is formed, the film is slowly cooled.

Next, a substrate layer is coated on the high-resistivity layer. While the cylindrical metallic mold the high-resistivity layer is formed on is slowly rotated, a coating liquid is coated on the whole outer surface with a liquid applicator such as a nozzle and a dispenser to form a coated film thereon. Then, the rotational speed is increased to a predetermined speed and the speed is maintained for a desired time. Then, the mold is gradually heated while rotated to vapor a solvent in the coated film at 80 to 150° C. In this process, it is preferable that an atmospheric mist (volatilized solvent) is efficiently circulated to remove. When a self-supporting film is formed, the mold is placed in a heating (burning) oven capable of heating at high temperature, and heated in stages and finally at 250 to 450° C. such that a polyimide resin precursor is fully imidized. After the imidization is completed, the film is slowly cooled and the belt is removed from the mold to have an inner surface covered by the high-resistivity layer.

When the high-resistivity layer is formed on the outer circumference of the belt as FIG. 2B shows, the substrate layer is coated first.

A toner for use in the present invention preferably has a circularity of from 0.95 to 0.98. Nearly a spherical toner improves in transferability and produces high-quality images.

The toner preferably as a volume-average particle diameter of from 4 to 8 μm, and more preferably from 4 to 5.2 μm. A toner having a smaller particle diameter improves in dot reproducibility, and particularly a toner having a particle diameter not greater than 5.2 μm produces high-definition images. However, too small, the toner has a problem in a cleaning process and preferably has a diameter not less than 4 μm.

The volume-average particle diameter and the circularity of a toner are measured by FPIA-2100 from Sysmex Corp.

The toner for use in the present invention is prepared by dispersing an organic solvent of toner materials including at least a binder resin and/or its prepolymer, a colorant and a release agent in an aqueous medium in the shape of a fine droplet, (or/and crosslinking and/or elongating the prepolymer while or after dispersing the organic solvent of toner materials), and removing the organic solvent the aqueous medium.

Preferably, at least a compound having an active hydrogen and a polymer having a site reactable with the active hydrogen (or a self-polymerizable material having both of an active hydrogen and a polymer having a site reactable therewith in its molecule), a colorant and a release agent, preferably in the form of a composition are dissolved or dispersed in an organic solvent. After or while the active hydrogen and the reactable site are reacted with each other in an aqueous medium, the organic solvent and the aqueous medium are removed, and the reactant is washed and dried. The circularity of a toner may be controlled by stirring strength when reacted or after dried. Various material can be used as the resin and/or the prepolymer, and particularly a polyester resin or/and a polyester prepolymer is/are preferably used.

This is one of the embodiments of methods of preparing a toner, and a spherical toner may be prepared by the other methods.

The image forming apparatus of the present invention is a tandem image forming apparatus using an intermediate transfer. The image forming apparatus drives a large image forming module to have high speed and high durability. The intermediate transfer belt for use in the present invention has a circumferential length not less than 2,000 mm and drives at a linear speed not less than 350 mm/sec.

FIG. 1 is a schematic view illustrating an embodiment of the image forming apparatus of the present invention.

The image forming apparatus of the present invention preferably has plural photoreceptor drums parallely along an intermediate transfer belt formed of a seamless belt to produce even full-color images at high speed. FIG. 1 is an embodiment of four-drum image forming apparatus including four photoreceptor drums 21BK, 21M, 21Y and 21C for forming four different color (black, magenta, yellow and cyan) toner images.

In FIG. 1, an image forming apparatus 10 is formed of an image writer 12, an image former 13 and a paper feeder 14 for forming electrophotographic full-color images. An image processor converts an image signal into each of black (BK), magenta (M), yellow (Y) and cyan (C) color signals and transmits them to the image writer 12. The writer 12 is a laser scanning optical system formed of a laser light source, a deflector such as a polygon mirror, a scanning imaging optical system and mirrors. The writer 12 has four light paths for each of the color signals and writes an image for each color on each of image bearers (photoreceptors) 21BK, 21M, 21Y and 21C for each color formed in the image former 13.

The image former 13 includes photoreceptors 21BK, 21M, 21Y and 21C which are image bearers for each of black (BK), magenta (M), yellow (Y) and cyan (C) colors. An OPC photoreceptor is typically used as the photoreceptor for each color. Around each of the photoreceptors 21BK, 21M, 21Y and 21C, a charger, an irradiator of the image writer 12, each of image developers 20BK, 20M, 20Y and 20C for each of black, magenta, yellow and cyan colors, each of first transfer bias rollers 23BK, 23M, 23Y and 23C as a first transferer, an unillustrated cleaner, an unillustrated discharger are located. Each of the image developers 20BK, 20M, 20Y and 20C used a two-component magnetic brush developing method. An intermediate transfer belt 22 intermediates between each of the photoreceptors 21BK, 21M, 21Y and 21C and each of first transfer bias rollers 23BK, 23M, 23Y and 23C, and each of color toner images formed on each of the photoreceptors are overlappingly transferred onto the belt.

Meanwhile, a transfer paper P is fed from the paper feeder 14, and borne by a transfer belt 50 through a registration roller 16. At a point where the intermediate transfer belt 22 and the transfer belt 50 contact each other, the toner image on the intermediate transfer belt 22 is second transferred (at a time) by a second transfer bias roller 60 as a second transferer onto the transfer paper P. Thus, a full-color image is formed thereon. The transfer paper P the full-color image is formed on is fed by the transfer belt 50 to a fixer 15, where the full-color image is fixed thereon, and discharged out of the image forming apparatus.

An untransferred residual toner remaining on the intermediate transfer belt 22 is removed therefrom by a belt cleaning member 25. A lubricant applicator 27 is located at downstream side of the belt cleaning member 25. The lubricant applicator 27 is formed of a solid lubricant and an electroconductive brush frictionizing the intermediate transfer belt 22 to apply the solid lubricant thereto. The electroconductive brush constantly contacts the intermediate transfer belt 22 to apply the solid lubricant thereto. The solid lubricant increases cleanability of the intermediate transfer belt 22, prevents filming, and improving durability thereof. Particularly, the lubricant is preferably applied thereto when a toner having a small particle diameter or high circularity is used because of having poor cleanability. Conventionally known lubricants can be used as the solid lubricant, and particularly zinc stearate imparts good cleanability to the intermediate transfer belt 22.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

A coating liquid was prepared to form a seamless belt.

<Preparation of Coating Liquid>

First, as a substrate layer coating liquid, a polyimide varnish (U-varnish S from Ube Industries, Ltd.) including a polyimide resin precursor as a main component, which is a reactant between 3,3',4,4'-biphenyltetracarboxylic dianhydride and p-phenylenediamine, and a polyimide varnish (U-varnish A from Ube Industries, Ltd.) including a polyimide resin precursor as a main component, which is a reactant between 3,3',4,4'-biphenyltetracarboxylic dianhydride and 4,4'-diaminodiphenylether were mixed such that a polyamic acid solid content weight ratio (S/A) of the U-varnish S to the U-varnish A is 10/90 to prepare a mixture. A dispersion including N-methyl-2-pyrrolidone in which carbon black (Special Black 4 from Evonik-Degussa GmbH) was dispersed by a beads mill was mixed with the mixture such that the carbon black (CB) content was 16.5% by weight of the polyamic acid solid content to prepare a substrate layer coating liquid.

The procedure for preparing the substrate layer coating liquid was repeated to prepare a high-resistivity layer coating liquid except for mixing the mixture with the dispersion such that the CB content was 16% by weight of the polyamic acid solid content.

A layered belt, on the outer circumference of which a high-resistivity layer is formed as FIG. 2B shows was prepared.

The substrate layer coating liquid was uniformly coated by a dispenser on the blasted and roughened outer surface of a cylindrical mold A having an outer diameter of 700 mm and a length of 400 mm while rotated at 50 rpm. When coating of a predetermined amount of the coating liquid was completed and the surface was uniformly coated, the coated mold was rotated at 100 rpm, placed in a hot air circulating dryer to be gradually heated up, and heated at 110° C. for 60 min. The coated mold was further heated at 200° C. for 20 min, the rotation thereof was stopped and the coated mold was slowly cooled and taken out a substrate layer was formed on.

Next, the high-resistivity layer coating liquid was coated on the substrate layer on the mold to form a high-resistivity layer thereon while rotated. The high-resistivity layer coating liquid was uniformly coated by a dispenser on the cylindrical substrate layer. When coating of a predetermined amount of the coating liquid was completed and the substrate layer was uniformly coated, the coated mold was rotated at 100 rpm, placed in a hot air circulating dryer to be gradually heated up, and heated at 110° C. for 60 min. The coated mold was further heated at 200° C. for 20 min, the rotation thereof was stopped and the coated mold was slowly cooled and taken out a high-resistivity layer was formed on. The coated mold was placed in a heating (burning) oven capable of heating at high temperature, and heated in stages to 320° C. and heated (burned) for 60 min such that the coated layers are imidized. After gradually cooled, the mold was released.

Thus, a belt A having a circumferential length of 2,200 mm and a width of 376 mm was prepared after an edge thereof was cut. The belt had a thickness ($t_2$) of 91 μm. The cross-section of the belt was observed by an SEM to find a high-resistivity layer was formed on the outer circumferential surface of the belt and had a thickness ($t_1$) of 32 μm.

The properties of the belt were evaluated as follows.

<Roughness of the Belt Surface Contacting Belt Drive Roller>

The belt A has an inner surface contacting a belt drive roller.

The inner surface (having contacted the outer surface of the mold) roughness of the belt was measured by SURFCOM 1400D from TOKYO SEIMITSU CO., LTD. according to JIS B0601: '01 at a measurement speed of 0.6 mm/sec, a cutoff value of 0.8 mm and a measurement length of 2.5 mm. Each 3 points in a circumferential direction at an interval of 733 mm and a width direction at an interval of 120 mm (center and both ends) of the belt (totally 9 points) were measured and averaged.

The belt A had an inner circumferential surface having a roughness Ra of 0.26 μm.

<Surface Resistivity>

The surface resistivity was measured by Hirester from Mitsubishi Chemical Corp. when the belt was applied with 500 V/10 sec. Each 3 points in a circumferential direction at an interval of 733 mm and a width direction at an interval of 120 mm (center and both ends) of the belt (totally 9 points) were measured and averaged. The resistivities of the outer and the inner circumferential surfaces were measured. A difference (ρs high−ρs sub) between a surface resistivity (ρs high) (common logarithm value log Ω/□) of the high-resistivity layer and a surface resistivity (ρs sub) (common logarithm value log Ω/□) of the substrate layer is shown in Tables 1-1 to 1-3.

Uneven surface resistivity of the belt was evaluated as well. A ratio (max/min) of a maximum value to a minimum value of the surface resistivities at the 9 points on the substrate layer were calculated to evaluate the uneven surface resistivity of the belt.

<Hygroscopic Linear Expansivity>

The hygroscopic linear expansivity was measured by the measurer in FIG. 3.

In FIG. 3, a polyimide sheet as a sample having a predetermined size, i.e., a width of 10 mm and a length of 70 mm cut from the center of a seamless belt was placed on arms a and a' such that a distance between inner sides of the arms a and a' was 50 mm, and a weight of aluminum weight b was adjusted such that a linear pressure to the sample was 150 g/cm.

A reflection laser micro gauge c was located below the weight b to measure a distance from the bottom thereof.

The measurer was placed in a constant temperature and humidity tank, and a difference (ΔL) between the expansions of the sample at 35° C. and 35% RH and 35° C. and 85% RH was measured to determine the hygroscopic linear expansivity, using the following formula:

$$\text{Hygroscopic linear expansivity (ppm/\% } RH) = (\Delta L/50 \text{ mm})/50\%.$$

Next, the belt was installed in an apparatus too evaluate.

<Evaluation Image Forming Apparatus>

The belt A having a circumferential length of 2,200 mm, a width of 376 mm and a thickness of 91 μm was installed in the tandem image forming apparatus in FIG. 1 as an intermediate transfer belt, and driven at a linear speed of 425 mm/sec to evaluate. The inner surface thereof contacted the drive roller.

<Toner>

A toner A prepared by a polymerization method, having a volume-average particle diameter of 5.2 μm and a circularity of 0.95 was used.

<Running Test]

200,000 letter images having a printed letter area of 5% were produced at 100 P/J in an environment of 23° C. and 50% RH. Further, 100,000 letter images having a printed letter area of 5% were produced at 100 P/J in an environment of 10° C. and 15% RH. Finally, 200,000 letter images having a printed letter area of 5% were produced at 100 P/J in an environment of 23° C. and 50% RH. Totally 500,000 images were produced to evaluate. Further, after 200,000, 300,000 and 500,000 images were produced, a solid image, a halftone image and thin line image were produced. Uniformity of the solid and halftone images, thin line reproducibility, and abnormal images such as a white spot and a residual image were evaluated. The highest rank is 5 and 2.5 or more is acceptable in practical use.

The results are shown in Tables 2-1 to 2-4.

Example 2

The procedure for preparation of the belt A in Example 1 was repeated to prepare a belt B having a circumferential length of 2,200 mm, a width of 376 mm except that the polyamic acid solid content weight ratios (S/A) of the U-varnish S to the U-varnish A in the substrate layer and the high-resistivity layer coating liquid were changed to 40/60, the CB content in the high-resistivity layer coating liquid was changed to 10.72% by weight, the amount of the high-resistivity layer coating liquid was changed to 1/3, and the mold A was changed to a mold B having the same size as that of the mold A and a blasted outer surface rougher than that thereof.

The belt had a thickness ($t_2$) of 77 μm. The cross-section of the belt was observed by an SEM to find a high-resistivity layer was formed on the outer circumferential surface of the belt and had a thickness ($t_1$) of 13 μm. The belt B had an inner circumferential surface having a roughness Ra of 0.39 μm.

The properties of the belt B are shown in Tables 1-1 to 1-3

<Running Test>]

The procedure of evaluation in Example 1 was repeated except for replacing the intermediate transfer belt with the belt B.

Example 3

The procedure for preparation of the belt A in Example 1 was repeated to prepare a belt C having a circumferential length of 2,200 mm, a width of 376 mm except that the polyamic acid solid content weight ratios (S/A) of the U-varnish S to the U-varnish A in the substrate layer and the high-resistivity layer coating liquid were changed to 0/100, the CB content in the substrate layer was changed to 17.2% by weight, the CB content in the high-resistivity layer coating liquid was changed to 10.72% by weight, the amount of the high-resistivity layer coating liquid was changed to 2/3, and the mold A was changed to a mold B having the same size as that of the mold A and a blasted outer surface rougher than that thereof.

The belt had a thickness ($t_2$) of 83.9 μm. The cross-section of the belt was observed by an SEM to find a high-resistivity layer was formed on the outer circumferential surface of the belt and had a thickness ($t_1$) of 20.5 μm. The belt C had an inner circumferential surface having a roughness Ra of 0.24 μm.

The properties of the belt C are shown in Tables 1-1 to 1-3.

<Running Test>

The procedure of evaluation in Example 1 was repeated except for replacing the intermediate transfer belt with the belt C.

<Anti-Curl Test after Left in High Temperature and High Humidity>

The belt C prepared in Example 3 was left in high temperature and high humidity to evaluate its anti-curl capability. Another belt C was prepared for this test.

The belt was installed in an intermediate transfer unit of the tandem image forming apparatus in FIG. 1 as an intermediate transfer belt with a tension.

The intermediate transfer unit was left in a constant-temperature tank having a high temperature of 45° C. and a high humidity 90% RH for 2 weeks. Then, the intermediate transfer unit was subjected to humidity conditioning for 4 hrs in an environment of normal temperature and normal humidity, and installed in the tandem image forming apparatus in FIG. 1 to produce a halftone image to evaluate.

The image had a partial horizontal stripe, which was caused by a curl of the intermediate transfer belt.

Example 4

Different from Example 1, a belt, on the inner circumferential surface of which a high-resistivity layer was formed as shown in FIG. 2A was prepared.

The procedure for preparation of the belt A in Example 1 was repeated to prepare a belt D having a circumferential length of 2,200 mm, a width of 376 mm except that the polyamic acid solid content weight ratios (S/A) of the U-varnish S to the U-varnish A in the substrate layer and the high-resistivity layer coating liquid were changed to 30/70, the CB content in the high-resistivity layer coating liquid was changed to 14.3% by weight, the amount of the high-resistivity layer coating liquid was changed to 1/3, and the substrate layer was coated after the high-resistivity layer was coated.

The belt had a thickness ($t_2$) of 81 μm. The cross-section of the belt was observed by an SEM to find a high-resistivity layer was formed on the inner circumferential surface of the belt and had a thickness ($t_1$) of 14 μm. The belt D had an inner circumferential surface having a roughness Ra of 0.25 μm.

The properties of the belt D are shown in Tables 1-1 to 1-3.

<Running Test>

The procedure of evaluation in Example 1 was repeated except for replacing the intermediate transfer belt with the belt D.

Example 5

Different from Example 1, a belt, on the inner circumferential surface of which a high-resistivity layer was formed as shown in FIG. 2A was prepared.

The procedure for preparation of the belt A in Example 1 was repeated to prepare a belt E having a circumferential length of 2,200 mm, a width of 376 mm except that the polyamic acid solid content weight ratio (S/A) of the U-varnish S to the U-varnish A in the substrate layer coating liquid was changed to 30/70, the polyamic acid solid content weight ratio (S/A) of the U-varnish S to the U-varnish A in the high-resistivity layer coating liquid was changed to 50/50, the CB content in the high-resistivity layer coating liquid was changed to 14.3% by weight, the amount of the high-resistivity layer coating liquid was changed to 1/3, and the substrate layer was coated after the high-resistivity layer was coated.

The belt had a thickness ($t_2$) of 79 μm. The cross-section of the belt was observed by an SEM to find a high-resistivity layer was formed on the inner circumferential surface of the belt and had a thickness ($t_1$) of 13.5 μm. The belt E had an inner circumferential surface having a roughness Ra of 0.24 μm.

The properties of the belt E are shown in Tables 1-1 to 1-3.

<Running Test>

The procedure of evaluation in Example 1 was repeated except for replacing the intermediate transfer belt with the belt E.

Example 6

The procedure of evaluation in Example 1 was repeated except for replacing the toner A with a toner B prepared by a polymerization method, having a volume-average particle diameter of 6.8 μm and a circularity of 0.95.

Example 7

The procedure of evaluation in Example 1 was repeated except for replacing the toner A with a toner C prepared by a polymerization method, having a volume-average particle diameter of 8.1 μm and a circularity of 0.95.

Example 8

The procedure of evaluation in Example 1 was repeated except for replacing the toner A with a toner D prepared by a pulverization, having a volume-average particle diameter of 8.4 μm and a circularity of 0.93.

Example 9

The procedure for preparation of the belt A in Example 1 was repeated to prepare a belt F having a circumferential length of 3,000 mm, a width of 376 mm except that the mold A was replaced with a cylindrical mold E having an outer diameter of 955 mm and a length of 400 mm and a blasted and roughened outer surface and the amounts of the substrate layer coating liquid and the high-resistivity layer coating liquid were changed to 1.3 times.

The belt had a thickness ($t_2$) of 87.4 μm. The cross-section of the belt was observed by an SEM to find a high-resistivity layer was formed on the outer circumferential surface of the belt and had a thickness ($t_1$) of 29.2 μm. The belt F had an inner circumferential surface having a roughness Ra of 0.24 μm.

The properties of the belt F are shown in Tables 1-1 to 1-3.

<Running Test>

The belt F was installed in a tandem image forming apparatus larger than that in FIG. 1 as an intermediate transfer belt, and driven at a linear speed of 500 mm/sec to evaluate. The inner surface thereof contacted the drive roller.

The toner D prepared by a pulverization, having a volume-average particle diameter of 8.4 μm and a circularity of 0.93 was used.

The procedure of evaluation in Example 1 was repeated except for changing the image forming apparatus and the linear speed of the intermediate transfer belt.

Example 10

Different from Example 1, a belt, on the inner circumferential surface of which a high-resistivity layer was formed as shown in FIG. 2A was prepared.

The procedure for preparation of the belt A in Example 1 was repeated to prepare a belt M having a circumferential length of 2,200 mm, a width of 376 mm except that the polyamic acid solid content weight ratios (S/A) of the U-varnish S to the U-varnish A in the substrate layer and the high-resistivity layer coating liquid were changed to 0/100, the CB content in the substrate layer was changed to 17.2% by weight, the CB content in the high-resistivity layer coating liquid was changed to 10.72% by weight, the substrate layer was coated after the high-resistivity layer was coated, and the amount of the high-resistivity layer coating liquid was changed to 2/3.

The belt had a thickness ($t_2$) of 84.5 μm. The cross-section of the belt was observed by an SEM to find a high-resistivity layer was formed on the inner circumferential surface of the belt and had a thickness ($t_1$) of 21.2 μm. The belt M had an inner circumferential surface having a roughness Ra of 0.24 μm.

The properties of the belt M are shown in Tables 1-1 to 1-3.

<Running Test>

The procedure of evaluation in Example 1 was repeated except for replacing the intermediate transfer belt with the belt M.

<Anti-Curl Test after Left in High Temperature and High Humidity>

The belt M prepared in Example 10 was left in high temperature and high humidity to evaluate its anti-curl capability. Another belt M was prepared for this test.

The belt was installed in an intermediate transfer unit of the tandem image forming apparatus in FIG. 1 as an intermediate transfer belt with a tension.

The intermediate transfer unit was left in a constant-temperature tank having a high temperature of 45° C. and a high humidity 90% RH for 2 weeks. Then, the intermediate transfer unit was subjected to humidity conditioning for 4 hrs in an environment of normal temperature and normal humidity, and installed in the tandem image forming apparatus in FIG. 1 to produce a halftone image to evaluate.

The belt M did not produce abnormal images such as horizontal stripe images as the belt C produced.

Example 11

Different from Example 1, a belt, on the inner circumferential surface of which a high-resistivity layer was formed as shown in FIG. 2A was prepared.

The procedure for preparation of the belt A in Example 1 was repeated to prepare a belt N having a circumferential length of 2,200 mm, a width of 376 mm except that the polyamic acid solid content weight ratios (S/A) of the U-varnish S to the U-varnish A in the substrate layer and the high-resistivity layer coating liquid were changed to 5/95, the CB content in the substrate layer was changed to 16.5% by weight, the CB content in the high-resistivity layer coating liquid was changed to 14.8% by weight, and the substrate layer was coated after the high-resistivity layer was coated.

The belt had a thickness ($t_2$) of 89.5 μm. The cross-section of the belt was observed by an SEM to find a high-resistivity layer was formed on the inner circumferential surface of the belt and had a thickness ($t_1$) of 31.0 μm. The belt N had an inner circumferential surface having a roughness Ra of 0.25 μm.

The properties of the belt N are shown in Tables 1-1 to 1-3.

<Running Test>

The procedure of evaluation in Example 1 was repeated except for replacing the intermediate transfer belt with the belt N.

Comparative Example 1

The procedure for preparation of the belt A in Example 1 was repeated to prepare a belt G having a circumferential length of 2,200 mm, a width of 376 mm except for not coating the high-resistivity layer.

The belt had a thickness ($t_2$) of 60.2 μm. The belt G had an inner circumferential surface having a roughness Ra of 0.24 μm.

The properties of the belt G are shown in Tables 1-1 to 1-3.

<Running Test>

The procedure of evaluation in Example 1 was repeated except for replacing the intermediate transfer belt with the belt G.

<Anti-Curl Test after Left in High Temperature and High Humidity>

The belt G prepared in Comparative Example 1 was left in high temperature and high humidity to evaluate its anti-curl capability. Another belt G was prepared for this test.

The belt was installed in an intermediate transfer unit of the tandem image forming apparatus in FIG. 1 as an intermediate transfer belt with a tension.

The intermediate transfer unit was left in a constant-temperature tank having a high temperature of 45° C. and a high humidity 90% RH for 2 weeks. Then, the intermediate transfer unit was subjected to humidity conditioning for 4 hrs in an environment of normal temperature and normal humidity, and installed in the tandem image forming apparatus in FIG. 1 to produce a halftone image to evaluate.

The belt G produced abnormal images such as horizontal stripe images as the belt C produced, which was caused by a curl of the intermediate transfer belt.

Comparative Example 2

The procedure for preparation of the belt A in Example 1 was repeated to prepare a belt H having a circumferential length of 2,200 mm, a width of 376 mm except that the polyamic acid solid content weight ratios (S/A) of the U-varnish S to the U-varnish A in the substrate layer and the high-resistivity layer coating liquid were changed to 50/50, the CB content in the high-resistivity layer coating liquid was changed to 10.72% by weight, and the substrate layer was coated after the high-resistivity layer was coated.

The belt had a thickness ($t_2$) of 81 μm. The cross-section of the belt was observed by an SEM to find a high-resistivity layer was formed on the inner circumferential surface of the belt and had a thickness ($t_1$) of 22 μm. The belt H had an inner circumferential surface having a roughness Ra of 0.26 μm.

The properties of the belt H are shown in Tables 1-1 to 1-3.

<Running Test>

The procedure of evaluation in Example 1 was repeated except for replacing the intermediate transfer belt with the belt H.

Comparative Example 3

The procedure for preparation of the belt A in Example 1 was repeated to prepare a belt I having a circumferential length of 2,200 mm, a width of 376 mm except that the polyamic acid solid content weight ratio (S/A) of the U-varnish S to the U-varnish A in the substrate layer coating liquid was changed to 35/65, the polyamic acid solid content weight ratio (S/A) of the U-varnish S to the U-varnish A in the high-resistivity layer coating liquid was changed to 80/20, the CB content in the high-resistivity layer coating liquid was changed to 14.3% by weight, the amount of the high-resistivity layer coating liquid was changed to 1/3, and the mold A was changed to a mold C having the same size as that of the mold A and a blasted outer surface smoother than that thereof.

The belt had a thickness ($t_2$) of 76.1 μm. The cross-section of the belt was observed by an SEM to find a high-resistivity layer was formed on the outer circumferential surface of the belt and had a thickness ($t_1$) of 13 μm. The belt I had an inner circumferential surface having a roughness Ra of 0.18 μm.

The properties of the belt I are shown in Tables 1-1 to 1-3.

<Running Test>

The procedure of evaluation in Example 1 was repeated except for replacing the intermediate transfer belt with the belt I.

Comparative Example 4

The procedure for preparation of the belt A in Example 1 was repeated to prepare a belt J having a circumferential length of 2,200 mm, a width of 376 mm except that the polyamic acid solid content weight ratios (S/A) of the U-varnish S to the U-varnish A in the substrate layer and the high-resistivity layer coating liquid were changed to 30/70, the CB content in the high-resistivity layer coating liquid was changed to 14.3% by weight, the mold A was changed to a mold D having the same size as that of the mold A and a blasted outer surface rougher than those of the mold A and mold B, and the substrate layer was coated after the high-resistivity layer was coated.

The belt had a thickness ($t_2$) of 91.5 μm. The cross-section of the belt was observed by an SEM to find a high-resistivity layer was formed on the inner circumferential surface of the belt and had a thickness ($t_1$) of 31 μm. The belt J had an inner circumferential surface having a roughness Ra of 0.43 μm.

The properties of the belt J are shown in Tables 1-1 to 1-3.

<Running Test>

The procedure of evaluation in Example 1 was repeated except for replacing the intermediate transfer belt with the belt J.

Comparative Example 5

The procedure for preparation of the belt A in Example 1 was repeated to prepare a belt K having a circumferential length of 2,200 mm, a width of 376 mm except that the CB content in the high-resistivity layer coating liquid was changed to 10.72% by weight and the CB content in the substrate coating liquid was changed to 17.2% by weight.

The belt had a thickness ($t_2$) of 91.5 μm. The cross-section of the belt was observed by an SEM to find a high-resistivity layer was formed on the outer circumferential surface of the belt and had a thickness ($t_1$) of 33 μm. The belt K had an inner circumferential surface having a roughness Ra of 0.25 μm.

The properties of the belt K are shown in Tables 1-1 to 1-3.

<Running Test>

The procedure of evaluation in Example 1 was repeated except for replacing the intermediate transfer belt with the belt K.

Comparative Example 6

The procedure for preparation of the belt A in Example 1 was repeated to prepare a belt L having a circumferential length of 2,200 mm, a width of 376 mm except that the CB content in the high-resistivity layer coating liquid was changed to 15.3% by weight and the amount of the high-resistivity layer coating liquid was changed to 2/3.

The belt had a thickness ($t_2$) of 82 μm. The cross-section of the belt was observed by an SEM to find a high-resistivity layer was formed on the outer circumferential surface of the belt and had a thickness ($t_1$) of 22.2 μm. The belt L had an inner circumferential surface having a roughness Ra of 0.24 μm.

The properties of the belt L are shown in Tables 1-1 to 1-3.

<Running Test>

The procedure of evaluation in Example 1 was repeated except for replacing the intermediate transfer belt with the belt L.

TABLES 1-1

| | | Substrate layer | | High-resistivity layer | | |
|---|---|---|---|---|---|---|
| | Mold | S/A | CB content (Wt. %) | Layered position | S/A | CB content (Wt. %) |
| Belt A | A | 10/90 | 16.5 | FIG. 2B | 10/90 | 15.0 |
| Belt B | B | 40/80 | 16.5 | FIG. 2B | 40/80 | 10.72 |
| Belt C | A | 0/100 | 17.2 | FIG. 2B | 0/100 | 10.72 |
| Belt D | A | 30/70 | 16.5 | FIG. 2A | 30/70 | 14.3 |
| Belt E | A | 30/70 | 16.5 | FIG. 2A | 50/50 | 14.3 |
| Belt F | E | 10/90 | 16.5 | FIG. 2B | 10/90 | 15.0 |
| Belt M | A | 0/100 | 17.2 | FIG. 2A | 0/100 | 10.72 |
| Belt N | A | 5/95 | 16.5 | FIG. 2A | 5/95 | 14.8 |
| Belt G | A | 10/90 | 16.5 | — | — | — |
| Belt H | A | 50/50 | 16.5 | FIG. 2A | 50/50 | 10.72 |
| Belt I | C | 35/65 | 16.5 | FIG. 2A | 80/20 | 14.3 |
| Belt J | D | 30/70 | 16.5 | FIG. 2A | 30/70 | 14.3 |
| Belt K | A | 10/90 | 17.2 | FIG. 2B | 10/90 | 10.72 |
| Belt L | A | 10/90 | 16.5 | FIG. 2B | 10/90 | 15.3 |

TABLE 1-2

| | | Thickness | | | |
|---|---|---|---|---|---|
| | Mold | Thickness of high-resistivity layer (μm) | Total thickness (μm) | Ratio of high-resistivity layer $t_1/t_2 \times 100$ | Surface roughness contacting to drive roller (μm) |
| Belt A | A | 32.0 | 91.0 | 35.2 | 0.26 |
| Belt B | B | 13.0 | 77.0 | 16.9 | 0.39 |
| Belt C | A | 20.5 | 83.9 | 24.5 | 0.24 |
| Belt D | A | 14.0 | 81.0 | 17.3 | 0.25 |
| Belt E | A | 13.5 | 79.0 | 17.1 | 0.24 |
| Belt F | E | 29.2 | 87.4 | 33.4 | 0.24 |
| Belt M | A | 21.2 | 84.5 | 25.1 | 0.24 |
| Belt N | A | 31.0 | 89.5 | 34.6 | 0.25 |
| Belt G | A | 60.2 | 0 | — | 0.24 |
| Belt H | A | 22.0 | 81.0 | 27.2 | 0.26 |
| Belt I | C | 13.0 | 76.1 | 17.1 | 0.18 |
| Belt J | D | 31.0 | 91.5 | 33.9 | 0.43 |
| Belt K | A | 33.0 | 91.5 | 36.1 | 0.25 |
| Belt L | A | 22.2 | 82 | 27.1 | 0.24 |

TABLE 1-3

| | | Surface resistivity | | | | Hygroscopic, |
|---|---|---|---|---|---|---|
| | Mold | ρs high (LogΩ/□) | ρs sub (LogΩ/□) | ρs high − ρs sub (LogΩ/□) | Unevenness of surface resistivity | linear expansivity (ppm/% RH) |
| Belt A | A | 11.64 | 11.25 | 0.38 | 1.03 | 21.5 |
| Belt B | B | 13.15 | 11.49 | 1.66 | 1.05 | 19 |
| Belt C | A | 12.98 | 10.52 | 2.46 | 1.02 | 25.2 |
| Belt D | A | 11.72 | 11.33 | 0.39 | 1.04 | 19.7 |
| Belt E | A | 11.69 | 11.33 | 0.36 | 1.04 | 19.8 |
| Belt F | E | 11.63 | 11.25 | 0.38 | 1.04 | 21.2 |
| Belt M | A | 13.01 | 10.52 | 2.49 | 1.02 | 25 |
| Belt N | A | 11.66 | 11.25 | 0.41 | 1.03 | 23.5 |
| Belt G | A | 11.24 | 11.21 | 0.03 | 1.03 | 22 |
| Belt H | A | 11.42 | 13.04 | 1.62 | 1.17 | 17.6 |
| Belt I | C | 11.34 | 11.72 | 0.38 | 1.04 | 17.9 |
| Belt J | D | 11.35 | 11.95 | 0.60 | 1.04 | 19.8 |
| Belt K | A | 10.55 | 13.25 | 2.70 | 1.03 | 21.8 |
| Belt L | A | 11.40 | 11.15 | 0.25 | 1.03 | 21.5 |

TABLE 2-1

| | Test conditions | | | Image quality with belt left in high-temperature and high-humidity (45° C./90% 2 weeks) |
|---|---|---|---|---|
| | Belt used | Toner used: Volume-average particle diameter | Toner used: Circularity | |
| Example 1 | Belt A | 5.2 | 0.95 | — |
| Example 2 | Belt B | 5.2 | 0.95 | — |
| Example 3 | Belt C | 5.2 | 0.95 | Partial horizontal stripe |
| Example 4 | Belt D | 5.2 | 0.95 | — |
| Example 5 | Belt E | 5.2 | 0.95 | — |
| Example 6 | Belt A | 6.8 | 0.95 | — |
| Example 7 | Belt A | 8.1 | 0.95 | — |
| Example 8 | Belt A | 8.4 | 0.93 | — |
| Example 9 | Belt F | 8.4 | 0.93 | — |
| Example 10 | Belt M | 5.2 | 0.95 | Nothing abnormal |
| Example 11 | Belt N | 5.2 | 0.95 | — |

TABLE 2-1-continued

| | Test conditions | | | Image quality with belt left in high-temperature and high-humidity (45° C./90% 2 weeks) |
|---|---|---|---|---|
| | Belt used | Toner used: Volume-average particle diameter | Toner used: Circularity | |
| Comparative Example 1 | Belt G | 5.2 | 0.95 | Partial horizontal stripe |
| Comparative Example 2 | Belt H | 5.2 | 0.95 | — |
| Comparative Example 3 | Belt I | 5.2 | 0.95 | — |
| Comparative Example 4 | Belt J | 5.2 | 0.95 | — |
| Comparative Example 5 | Belt K | 5.2 | 0.95 | — |
| Comparative Example 6 | Belt L | 5.2 | 0.95 | — |

TABLE 2-2

| | Running test 0 to 200K (MM environment) | | | | | | |
|---|---|---|---|---|---|---|---|
| | | Image quality evaluation | | | Abnormal image | | |
| | Belt used | Halftone | Thin line | Solid image | White spot | Residual image | Abnormal |
| Example 1 | A | 4 | 4 | 4 | 4 | 4.5 | Nothing |
| Example 2 | B | 4 | 4 | 4 | 4.5 | 4 | Nothing |
| Example 3 | C | 4 | 4 | 4 | 4.5 | 3.5 | Nothing |
| Example 4 | D | 4 | 4 | 4 | 4 | 4.5 | Nothing |
| Example 5 | E | 4 | 4 | 4 | 4 | 4.5 | Nothing |
| Example 6 | A | 3.5 | 3.5 | 3.5 | 4 | 4.5 | Nothing |
| Example 7 | A | 3 | 3 | 3.5 | 4 | 4.5 | Nothing |
| Example 8 | A | 2.5 | 2.5 | 3 | 4 | 4.5 | Nothing |
| Example 9 | F | 2.5 | 2.5 | 3 | 4 | 4.5 | Nothing |
| Example 10 | M | 4 | 4 | 4 | 4.5 | 3.5 | Nothing |
| Example 11 | N | 4 | 4 | 4 | 4 | 4.5 | Nothing |
| Comparative Example 1 | G | 4 | 4 | 4 | 3 | 4.5 | Nothing |
| Comparative Example 2 | H | 2 | 3 | 2 | 4.5 | 4 | A-1 |
| Comparative Example 3 | I | — | — | — | — | — | A-2 |
| Comparative Example 4 | J | — | — | — | — | — | A-3 |
| Comparative Example 5 | K | 4 | 4 | 4 | 4.5 | 2 | A-4 |
| Comparative Example 6 | L | 4 | 4 | 4 | 3.5 | 4 | Nothing |

TABLE 2-3

| | Running test 200 to 300K (LL environment) | | | | | | |
|---|---|---|---|---|---|---|---|
| | | Image quality evaluation | | | Abnormal image | | |
| | Belt used | Halftone | Thin line | Solid image | White spot | Residual image | Abnormal |
| Example 1 | A | 4 | 4 | 4 | 3 | 4.5 | Nothing |
| Example 2 | B | 3.5 | 4 | 4 | 3.5 | 4 | Nothing |
| Example 3 | C | 4 | 4 | 4 | 4 | 3.5 | Nothing |
| Example 4 | D | 3.5 | 4 | 4 | 3 | 4.5 | Nothing |
| Example 5 | E | 3.5 | 4 | 4 | 3 | 4.5 | Nothing |
| Example 6 | A | 3.5 | 3.5 | 3.5 | 3 | 4.5 | Nothing |
| Example 7 | A | 3 | 3 | 3.5 | 3 | 4.5 | Nothing |
| Example 8 | A | 2.5 | 2.5 | 3 | 3 | 4.5 | Nothing |

TABLE 2-3-continued

| | | Running test 200 to 300K (LL environment) | | | | | |
|---|---|---|---|---|---|---|---|
| | | Image quality evaluation | | | Abnormal image | | |
| | Belt used | Halftone | Thin line | Solid image | White spot | Residual image | Abnormal |
| Example 9 | F | 2.5 | 2.5 | 3 | 3 | 4.5 | Nothing |
| Example 10 | M | 4 | 4 | 4 | 4 | 3.5 | Nothing |
| Example 11 | N | 4 | 4 | 4 | 3 | 4.5 | Nothing |
| Comparative Example 1 | G | 3 | 4 | 3 | 1.5 | 4.5 | Nothing |
| Comparative Example 2 | H | — | — | — | — | — | B |
| Comparative Example 3 | I | — | — | — | — | — | A-2 |
| Comparative Example 4 | J | — | — | — | — | — | — |
| Comparative Example 5 | K | — | — | — | — | — | — |
| Comparative Example 6 | L | 3 | 4 | 3 | 2 | 4.5 | B |

TABLE 2-4

| | | Running test 300 to 500K (MM environment) | | | | | |
|---|---|---|---|---|---|---|---|
| | | Image quality evaluation | | | Abnormal image | | |
| | Belt used | Halftone | Thin line | Solid image | White spot | Residual image | Abnormal |
| Example 1 | A | 4 | 4 | 4 | 3 | 4.5 | C |
| Example 2 | B | 3.5 | 4 | 4 | 3.5 | 4 | Nothing |
| Example 3 | C | 4 | 4 | 4 | 4 | 3.5 | C |
| Example 4 | D | 3.5 | 4 | 4 | 3 | 4.5 | C |
| Example 5 | E | 3.5 | 4 | 4 | 3 | 4.5 | Nothing |
| Example 6 | A | 3.5 | 3.5 | 3.5 | 3 | 4.5 | C |
| Example 7 | A | 3 | 3 | 3.5 | 3 | 4.5 | C |
| Example 8 | A | 2.5 | 2.5 | 3 | 3 | 4.5 | C |
| Example 9 | F | 2.5 | 2.5 | 3 | 3 | 4.5 | C |
| Example 10 | M | 4 | 4 | 4 | 4 | 3.5 | C |
| Example 11 | N | 4 | 4 | 4 | 3 | 4.5 | C |
| Comparative Example 1 | G | 3 | 4 | 3 | 1.5 | 4.5 | — |
| Comparative Example 2 | H | — | — | — | — | — | — |
| Comparative Example 3 | I | — | — | — | — | — | — |
| Comparative Example 4 | J | — | — | — | — | — | — |
| Comparative Example 5 | K | — | — | — | — | — | — |
| Comparative Example 6 | L | 3 | 4 | 3 | 2 | 4.5 | — |

A-1: An end of the belt was partially damaged.
A-2: The belt shifted so much that an end of the belt was seriously damaged, and the test stopped.
A-3: Images having shifted colors due to slip of the belt were frequently produced, and the test stopped.
A-4: The rank of residual image was over an acceptable range, and the test stopped.
B: The rank of white spot was over an acceptable range, and the test stopped.
C: No influence on images, but an end of the belt was slightly damaged.

Examples 1 to 5 are layered belts including a substrate layer and a high-resistivity layer for an intermediate transfer belt. The high-resistivity layer has a surface resistivity higher than that of the substrate layer by 0.3 to 2.5 log Ω/□ in common logarithm value when applied with a voltage of 500 V. The substrate layer is formed of a polyimide resin comprising a polyimide resin component (S) having an imide bond between 3,3',4,4'-biphenyltetracarboxylic dianhydride and p-phenylenediamine and a polyimide resin component (A) having an imide bond between 3,3',4,4'-biphenyltetracarboxylic dianhydride and 4,4'-diaminodiphenylether in a weight ratio (S/A) of from 0/100 to 40/60. The intermediate transfer belt has a surface contacting a belt drive roller, which has a surface roughness Ra of from 0.2 to 0.4 μm when measured by a method specified in JIS B0601: '01. Even when large, the belt has less uneven resistivity to produce quality images without white spot and residual image, and stably drives without shifting or slipping even at high speed.

Compared Example 3 with Example 10, a high-resistivity layer layered on an inner circumferential surface, including less CB has higher anti-curl capability and produces less abnormal image due to curl even after left in an environment of high-temperature and high-humidity.

Compared Examples 1 to 5 with Examples 6 to 8, a toner having a small particle diameter and a large circularity further improves image quality.

In Examples 1 to 11, the substrate layer formed of a polyimide resin including S having a large ratio tends to have smaller hygroscopic linear expansivity, and particularly the belts having S not less than 10% have good hygroscopic linear expansivity.

In Comparative Example 1, a high-resistivity layer was not formed, the rank of white spot is 1.5 in LL environment, which is not in an acceptable range.

In Comparative Example 6, although a high-resistivity layer was formed, the high-resistivity layer and the substrate layer has a difference less than 0.3 log Ω/□ in their surface resistivities, The rank of white spot is 2 in LL environment, which is not in an acceptable range.

In Comparative Example 2, the substrate layer has an S/A ratio of 50/50 and unevenness of the resistivity is large, and the solid images and the halftone image have rank 2, which is not in an acceptable range in practical use.

In Comparative Example 3, the belt has a surface contacting a drive roller, which has a small surface roughness, and a frictional force between the drive roller and the belt is large. The belts shifts while running and an end thereof is seriously damaged.

In Comparative Example 4, the belt has a surface contacting a drive roller, which has a large surface roughness, and a contact area between the drive roller and the belt decreases, resulting in slip of the drive roller on the belt.

In Comparative Example 6, although a high-resistivity layer was formed, the high-resistivity layer and the substrate layer has a difference larger than 2.5 log Ω/□ in their surface resistivities, and the rank of residual image is over an acceptable range.

Having now fully described the invention, it will be apparent to one of ordinary skill in the art that many changes and modifications can be made thereto without departing from the spirit and scope of the invention as set forth therein.

What is claimed is:

1. An image forming apparatus, comprising:

an image bearer configured to bear an image;

an irradiator configured to irradiate the image bearer to form an electrostatic latent image thereon;

an image developer configured to develop the electrostatic latent image with a developer comprising a toner to form a toner image;

a transferer comprising an intermediate transfer belt configured to transfer a toner image onto a recording medium; and a fixer configured to fix the toner image on the recording medium, wherein the intermediate transfer belt has a circumferential length not less than 2,000 mm and is driven at a linear speed not less than 350 mm/sec, has an inner circumferential surface having a surface roughness Ra of from 0.2 to 0.4 μm, and comprises a substrate layer and a high-resistivity layer having a resistivity higher than that of the substrate layer, wherein the high-resistivity layer has a surface resistivity higher than that of the substrate layer by 0.3 to 2.5 log Ω/□ in common logarithm value when applied with a voltage of 500 V, and wherein the substrate layer is formed of a polyimide resin comprising a polyimide resin component (S) having an imide bond between 3,3',4,4'-biphenyltetracarboxylic dianhydride and p-phenylenediamine and a polyimide resin component (A) having an imide bond between 3,3',4,4'-biphenyltetracarboxylic dianhydride and 4,4'-diaminodiphenylether in a weight ratio (S/A) of from 0/100 to 40/60.

2. The image forming apparatus of claim 1, wherein the high-resistivity layer is layered on an inner circumferential surface of the intermediate transfer belt and is formed of a polyimide resin having the weight ratio (S/A) of from 60/40 to 100/0.

3. The image forming apparatus of claim 1, wherein the high-resistivity layer is layered on an inner circumferential surface of the intermediate transfer belt, the substrate layer and the high-resistivity layer are formed of a polyimide resin having the same weight ratio (S/A), the same carbon black is dispersed in the polyimide resin, and the polyimide resin of the high-resistivity layer includes the carbon black less than that of the substrate layer by weight.

4. The image forming apparatus of claim 1, wherein the substrate layer is formed of the polyimide resin having the weight ratio (S/A) of from 10/100 to 40/60 and has a hygroscopic linear expansivity not greater than 22 ppm/% RH.

5. The image forming apparatus of claim 1, wherein the toner has a circularity of from 0.95 to 0.98.

6. The image forming apparatus of claim 1, wherein the toner has a volume-average particle diameter of from 4 to 8 μm.

7. The image forming apparatus of claim 6, wherein the toner has a volume-average particle diameter of from 4 to 5.2 μm.

8. The image forming apparatus of claim 1, further comprising a solid lubricant applicator configured to apply a lubricant to the intermediate transfer belt.

9. The image forming apparatus of claim 8, wherein the lubricant is zinc stearate.

* * * * *